United States Patent [19]

Kuwamoto et al.

[11] Patent Number: 4,693,839

[45] **Date of Patent: * Sep. 15, 1987**

[54] METAL ROLLING OIL COMPOSITION

[75] Inventors: Hiroshi Kuwamoto; Shuichi Iwadoo; Yuji Okami, all of Fukuyama; Hiroyuki Nagamori; Yasuhiro Nakagawa, both of Wakayama, all of Japan

[73] Assignees: Kao Corporation; Nippon Kokan Kabushiki Kaisha, both of Tokyo, Japan

[ * ] Notice: The portion of the term of this patent subsequent to May 5, 2004 has been disclaimed.

[21] Appl. No.: 430,377

[22] Filed: Sep. 30, 1982

[30] Foreign Application Priority Data

Dec. 18, 1981 [JP] Japan ..... 56-204623

[51] Int. Cl.[4] ..... C10M 145/14

[52] U.S. Cl. ..... 252/51.5 A; 252/51.5 R; 252/56 S

[58] Field of Search ..... 252/51.5 A, 51.5 R, 252/56 S

[56] References Cited

U.S. PATENT DOCUMENTS

| | | | |
|---|---|---|---|
| 4,281,081 | 7/1981 | Jost et al. | 252/51.5 A |
| 4,320,019 | 3/1982 | Hayashi | 252/51.5 A |
| 4,489,194 | 12/1984 | Hayashi | 252/51.5 A |
| 4,490,267 | 12/1984 | Eckert | 252/51.5 A |

*Primary Examiner*—Jacqueline V. Howard

*Attorney, Agent, or Firm*—Oblon, Fisher, Spivak, McClelland & Maier

[57] ABSTRACT

Disclosed herein is novel metal rolling oil compositions comprising lubricant oil components and specific type of water-soluble cationic or amphoteric polymer compounds, which are selected from the group consisting of polymer compounds having at least one recurring unit and having an average molecular weight of from 1,000 to 10,000,000.

The thus obtained metal rolling oil composition gives a stable size distribution of relatively large sizes under agitating conditions of high shearing force and is useful as a rolling oil having a high lubricating and rolling performance with a reduced timewise change.

4 Claims, 3 Drawing Figures

METAL ROLLING OIL COMPOSITION

BACKGROUND OF THE INVENTION

1. Field of the Invention

This invention relates to novel metal rolling oil compositions and more particularly, to metal rolling oil compositions comprising lubricant oil components and water-soluble cationic or amphoteric polymer compounds.

2. Description of the Prior Art

Generally and hitherto employed metal rolling oils comprise lubricant oil components such as fats and oils, mineral oils or aliphatic esters admixed with auxiliary agents such as oily improvers, extreme pressure additives, rust inhibitors, antioxidants and the like. These components are formed into an O/W-type emulsion using emulsifiers and supplied to the rolling process generally at a concentration of 1 to 20%. The recent, rapid advancement in rolling facilities and techniques permits high speed rolling and mass production and hence the demand on rolling oils with respect to their circulating lubrication stability, workability, waste water treatability and the like becomes severer. Accordingly, the development of such rolling oils as to meet the above demand is strongly desired. In this connection, however, conventional rolling oils using emulsifiers have a number of difficulties and are not satisfactory. That is, in knwon rolling oils using emulsifiers, the rolling lubrication is controlled by changing the type and amount of emulsifiers and controlling the amount of oil (plating-out amount) deposited on the surface of materials to be rolled. However, in these rolling oils using emulsifiers, the plating-out amount and the liquid circulation stability tend to be contrary to each other, i.e. an increasing stability of emulsion results in insufficient lubricativeness because of the reduction of the plating-out amount on rolling materials. An increase of the plating-out amount causes the emulsion unstable with the attendant drawbacks such as various troubles in application by circulation.

The present inventors have made studies so as to overcome the drawbacks of the known emulsified rolling oils and succeeded in overcoming the drawbacks and applied for a patent (Japanese Laid-open No. 55-147593) in which lubricating components containing fats or waxes are so dispersed using a specific type of hydrophilic dispersant that they are stably suspended and dispersed in water in the form of oil particles.

We have made further studies and found that although the rolling oils of such preceding application are much improved over the known emulsified rolling oils, there is still left the problem that the particles are more finely divided under conditions of a shearing force higher than a certain level (10,000 r.p.m. of a homogenizer mixer) s will be shown in examples 1–3 appearing hereinafter, so that it is difficult to form a thick, tight lubricating film on a metal material to be rolled.

SUMMARY OF THE INVENTION

In order to provide metal rolling oil compositions which can be employed under high shearing conditions and high speed and high pressure rolling conditions where the rolling speed is high and the rolling reduction rate is large as will occur in practice, an intensive study has been made and it was found that the above object can be achieved by using specific types of water-soluble cationic or amphoteric polymer compounds instead of the above hydrophilic dispersants.

More specifically, it has been found that specific types of water-soluble cationic or amphoteric polymer compounds have the function of protective colloids, so that lubricating oil components are stably dispersed in water while keeping large particle sizes, showing good circulation stability and that upon contact with metal materials to be rolled and rolls by feeding these mentioned dispersions to the rolling unit, oil particles of large sizes can form a thick and tight lubricant film and the large-sized particles are stably held against the shearing force exerted thereon by agitated tanks and feed and circulation pumps over a long term of circulation.

According to the present invention, there is provided a metal rolling oil composition which comprises as essential components (a) at least one lubricating oil component selected from the group consisting of fats and oils, mineral oils and aliphatic acid esters, and (b) at least one water-soluble cationic or amphoteric polymer compound selected from the group consisting of polymer compounds having at least one basic nitrogen atom or cationic nitrogen atom in one recurring unit and having an average molecular weight ranging from 1,000 to 10,000,000.

DETAILED DESCRIPTION OF THE INVENTION AND PREFERRED EMBODIMENTS

Figure 1:
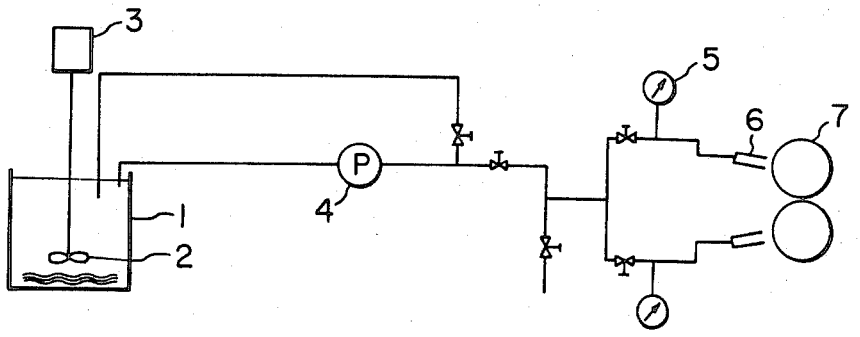
FIG. 1 shows an apparatus for carrying out the rolling test of rolling oil compositions of the invention.

The lubricating oil components which are the component (a) of the rolling oil composition of the invention include, for example, mineral oils such as spindle oils, machine oils, turbine oils, cylinder oils and the like, animal and plants oils such as whale oil, beef tallow, lard oil, rapeseed oil, castor oil, rice bran oil, palm oil, coconut oil and the like, and esters such as of fatty acids obtained from beef tallow, coconut oil, palm oil, castor oil and the like and aliphatic alcohols having 1 to 22 carbon atoms, ethylene glycol, neopentyl alcohol, pentaerithritol and the like. These components may be used singly or in combination.

The (b) components of the water-soluble cationic or amphoteric polymer compounds should essentially contain basic nitrogen atoms or cationic nitrogen atoms therein and may further contain in the molecule thereof the groups of carboxylates, sulfonates, amides esters.

Examples of these polymer compounds are as follows.

(a) Homopolymers or copolymers of salts or quaternary ammonium salts of nitrogen-containing monomers represented by the following general formulae (I) to (V).

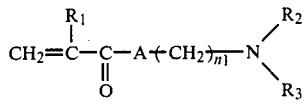

(I)

in which A represents —O— or —NH—, $n_1$ is an integer of 1 to 3, $R_1$ represents H or $CH_3$, and $R_2$ and $R_3$ independently represent H, $CH_3$ or $C_2H_5$;

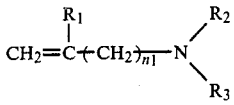

(II)

in which $R_1$, $R_2$, $R_3$ and $n_1$ have the same meanings as defined in the formula (I), respectively;

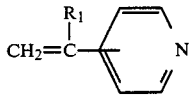

(III)

in which $R_1$ has the same meaning as defined in the formula (I), and the pyridine is substituted at 2- or 4-position;

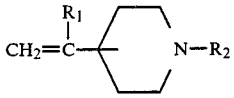

(IV)

in which $R_1$ and $R_2$ have the same meanings as defined in the formula (I), respectivey, and the piperidine is substituted at 2- or 4-position, and

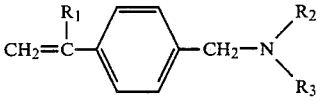

(V)

in which $R_1$, $R_2$ and $R_3$ have the same meanings as defined in the formula (I), respectively.

Examples of these monomers include: those of the formula (I) such as dimethylaminoethyl acrylate, diethylaminoethyl acrylate, dimethylaminoethyl methacrylate, diethylaminoethyl methacrylate, dimethylaminopropyl acrylamide, diethylaminopropyl acrylamide, dimethylaminopropyl methacrylamide, diethylaminopropyl methacrylamide and the like; those of the formula (II) such as dimethylaminomethylethylene, diethylaminomethylethylene, dimethylaminomethylpropene, diethylaminomethylpropene and the like; those of the formula (III) such as vinylpyridine and the like; those of the formula (IV) such as vinylpiperidine, vinyl-N-methylpiperidine and the like; and those of the formula (V) such as vinylbenzylamine, vinyl-N,N-dimethylbenzylamine and the like.

The homopolymers or copolymers of these monomers should have an average molecular weight of 1,000 to 10,000,000.

(b) Copolymers of one or more of the nitrogen-containing monomers of the general formula (I) through (V) or their salts or quaternary ammonium salts, and one or more vinyl monomers selected from the group consisting of $\alpha,\beta$-unsaturated carboxylic acids and, their salts or derivatives, sulfonic acid group-containing vinyl compounds and their salts, acrylonitrile, vinylpyrrolidone and aliphatic olefins having 2 to 20 carbon atoms.

Examples of the vinyl monomers include: vinylpyrrolidone and acrylonitrile; acrylic acid, methacrylic acid and maleic acid, and alkali metal salts, ammonium salts, amide compounds and ester compounds thereof; and vinylsulfonic acid, methallylsulfonic acid, 2-acrylamide-2-methylpropanesulfonic acid, p-styrenesulfonic acid and alkali metal salts and ammonium salts thereof. Among copolymers of the nitrogen-containing monomers and vinyl monomers, those having an average molecular weight of 1,000 to 10,000,000 are used.

(c) Salts and quaternary ammonium salts of ring-opened polymers of ethyleneimine.

These polymers have the recurring units of the general formula (VI) and an average molecular weight of 1,000 to 10,000,000.

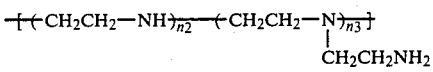

(VI)

in which $n_2$ is an integer of 1 to 5, and $n_3$ is an integer of 0 to 5.

(d) Salts or quaternary ammonium salts of polycondensation products of aliphatic dicarboxylic acids and polyethylenepolyamine or dipolyoxyethylenealkylamines.

Examples of these polymers are polycondensation products with polyethylenepolyamines of the recurring units represented by the general formula (VII) and polycondensation products with dipolyoxyethylenealkylamines represented by the general formula (VIII), whose molecular weight is in the range of 1,000 to 10,000,000.

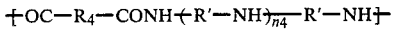

(VII)

in which $R_4$ represents a dimeric acid residue or an alkylene group having 1 to 10 carbon atoms, R' represents $—CH_2CH_2—$, and $n_4$ is an integer of 2 to 7.

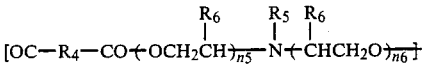

(VIII)

in which $R_4$ has the same meaning as defined in the formula (VII), $R_5$ represents an alkyl group having 1 to 8 carbon atoms, $R_6$ represents H or $CH_3$, and $n_5$ and $n_6$ are independently an integer of 1 to 10.

The aliphatic dicarboxylic acids are dimeric acid, adipic acid and the like, and the polyethylenepolyamines are diethylenetriamine, triethylenetetramine and the like.

(e) Polymerization products of dihaloalkanepolyalkylenepolyamines.

These products are polycondensations products of dihaloalkanes such as 1,2-dichloroethane, 1,2-dibromoethane, 1,3-dichloropropane and the like, and quaternary ammonium salts of polyalkylenepolyamines having two or more tertiary amino groups in the molecule thereof, whose average molecular weight is in the range of 1,000 to 10,000,000.

Examples of the polyalkylenepolyamines include:

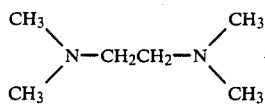

(tetramethylethylenediamine)

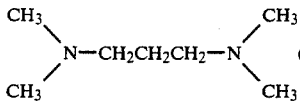

(tetramethylpropylenediamine)

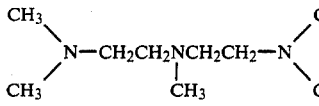

(pentamethyldiethylenetriamine)

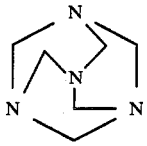

(hexamethylenetetramine)

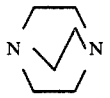

(triethylenediamine)

(f) Polycondensation products of epihalohydrinamines.

There are mentioned those products having the recurring units of the following general formula (X) and an average molecular weight of 1,000 to 10,000,000.

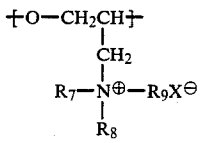

(X)

in which $R_7$–$R_9$ represent —$CH_3$ or —$C_2H_5$, and $X^{\ominus}$ represents a halogen ion.

(g) salts of chitosan, and cationized products of starch or cellulose.

The polymers of (a) to (f) should preferably have an average molecular weight of 10,000 to 1,000,000.

Although not completely known, the functions of the water-soluble cationic or amphoteric polymer compounds defined in (a) to (g) are considered as follows. A water-soluble cationic or amphoteric polymer compound which is completely dissolved in an aqueous phase adsorbs particles of a lubricating oil component, which has been finely divided by the mechanical shearing force, prior to their combination into a mass and serves to combine the oil particles as they are into larger-size particles by some coagulating action. These larger-size particles are held dispersed stably in water by the steric and electrical, protective, colloidal action of the polymer compound. This is contrary to the case of the Japanese Laid-open Application No. 55-147593 using water-soluble anionic polymer compounds in which because of the samll coagulating action of such compound on oil particles, the oil particles are stabilized in the form of fine particles by the protective colloidal action of the compound and thus once finely divided oil particles cannot be converted into larger-size particles.

These water-soluble cationic or amphoteric polymer compounds can be used singly or in combination and are preferably used in an amount of 0.1 to 10 wt% of the total of the oil composition.

Examples of anions to be paired to form the salts or quaternary ammonium salts of nitrogen-containing monomers which give water-soluble cationic or amphoteric polymer compounds include, sulfate ion, nitrate ion, chloride ion, hydroxyacetate ion, acetate ion, phosphate ion, among which preferable ions are organic or inorganic phosphate ion which has an acidic phosphoric acid group and borate ion from the view of lubrication or rust inhibition property, however, applicable pair ions should not be limited to the above-illustrated ions.

Aside from the components described above, the rolling oil composition of the present invention may be admixed with other known various additives, if necessary, such as rust inhibitor, oil improvers, extreme pressure additives, antioxidants and the like, which may be added in amounts of 0 to 2%, 0 to 20%, 0 to 3%, and 0 to 5% of the total of the oil composition, respectively.

The rust inhibitors include, for example, alkenylsuccinic acid or its derivatives, aliphatic acids such as oleic acid, esters such as sorbitan monooleate, and the like. The oil improvers include higher fatty acids such as oleic acid, stearic acid and the like and their derivatives or esters, dibasic acids such as dimeric acid, and the like. The extreme pressure additives include phosphorus compounds such as tricresyl phosphate, organic metal compounds such as zinc dialkyldithiophosphates, and the like. The antioxidants include phenolic compounds such as 2,4-di-t-butyl-p-cresol, aromatic amines such as phenyl-α-naphthylamine, and the like.

The metal rolling oil composition of the invention is used by merely mixing the rolling oil component and the water-soluble polymer compound, or is first prepared as athick solution with a water content up to about 80% and diluted with water on application.

The thus obtained metal rolling oil composition gives a stable size distribution of relatively large sizes under agitating conditions of high shearing force and is useful as a rolling oil having a high lubricating and rolling performance with a reduced timewise change. Moreover, it has the following advantages: the water-soluble cationic or amphoteric polymer compounds themselves used in the present invention have the function of rapidly adsorb either liquid or solid particles and rendering them hydrophilic but not the ability of lowering surface tensions of water and oil for emulsification, so that no emulsification of the lubricating oil component takes place, resulting in less occurrence of the so-called "taking-in" phenomenon for so-called "contaminants" such as fine metal powders, a lubricating-oil for roll bearings, an anti-rusting oil applied after pickling and the like in actual rolling operations as in the case of rolling oils using emulsifiers. The oil composition can invariably be held as a clean rolling oil with high rolling lubricating characteristics. These functions of both the components can sweep clear of smudges on tanks or housings in a mill. In addition, the composition involves little troubles in treating waste water, showing the advantage that a clean working evironment can be realized as will not be experienced in conventional rolling oils using emulsifiers.

The present invention is described by way of examples.

Rolling oil compositions used in examples have the following formulations. Water-soluble cationic or amphoteric polymer compounds are merely shown as "water-soluble polymer dispersing agent". In examples, percent is by weight.

Inventive Composition No. 1

| | |
|---|---|
| Beef tallow | 97.0% |
| Water-soluble polymeric dispersing agent (A) | 3.0 |

A: Polymer of quaternary ammonium salt of dimethylaminopropyl methacrylamide by methyl chloride (MW = 800,000)

Inventive Composition No. 2

| | |
|---|---|
| Beef tallow | 97.0% |
| Water-soluble polymeric dispersing agent (B) | 3.0 |

B: Copolymer of neutralized product of dimethylaminoethyl methacrylate with glycollic acid/ sodium acrylate (6/1; MW = 500,000)

Inventive Composition No. 3

| | |
|---|---|
| Beef tallow | 96.0% |
| Beef tallow fatty acid | 2.0 |
| Antioxidant | 1.0 |
| Water-soluble polymeric dispersing agent (C) | 1.0 |

C: Copolymer of quaternary ammonium salt of vinylpyridine by dimethyl sulfate/vinylpyrrolidone/ sodium acrylate (6/3/1; MW = 450,000)

Inventive Composition No. 4

| | |
|---|---|
| Beef tallow | 96.0% |
| Beef tallow fatty acid | 2.0 |
| Antioxidant | 1.0 |
| Water-soluble polymeric dispersing agent (D) | 1.0 |

D: Copolymer of neutralized product of dimethylaminoethyl methacrylate with glycollic acid/ sodium 2-acrylamino-2-methylpropanesulfonate (4/1; MW = 100,000)

Inventive Composition No. 5

| | |
|---|---|
| Beef tallow | 99.0% |
| Water-soluble polymeric dispersing agent (E) | 1.0 |

E: Neutralized product of polyethyleneimine with phosphoric acid (MW = 70,000)

Inventive Composition No. 6

| | |
|---|---|
| Paraffin mineral oil | 85.0% |
| Butyl stearate | 9.5 |
| Oleic acid | 4.0 |
| Antioxidant | 1.0 |
| Water-soluble polymeric dispersing agent (F) | 0.5 |

F: Cationized product of cellulose-quaternary ammonium salt (MW = 1,000,000)

Inventive Composition No. 7

| | |
|---|---|
| Beef tallow | 96.0% |
| Beef tallow fatty acid | 2.0 |
| Antioxidant | 1.0 |
| Water-soluble polymeric dispersing agent (G) | 1.0 |

G: Polycondensation product of 1,2-dichloroethane and hexamethylenetetramine (MW = 50,000)

Inventive Composition No. 8

| | |
|---|---|
| Methyl stearate | 87.0% |
| Dimeric acid | 5.0% |
| Phosphoric ester extreme pressure additive | 2.0 |
| Antioxidant | 1.0 |
| Water-soluble polymeric dispersing agent (H) | 5.0 |

H: Neutralized product of polycondensation product of dimeric acid and diethylenetriamine with phosphoric acid (MW = 800,000)

Inventive Composition No. 9

| | |
|---|---|
| Paraffin mineral oil | 65.0% |
| 2-ethylhexyl beef tallow fatty acid ester | 25.0 |
| Beef tallow fatty acid | 6.0 |
| Phosphoric ester extreme pressure additive | 2.0 |
| Antioxidant | 1.0 |
| Water-soluble polymeric dispersing agent (I) | 1.0 |

-continued

I: Ring-opened polymer of epichlorohydrin quaternized with trimethylamine (MW = 15,000)

Inventive Composition No. 10

| | |
|---|---|
| Beef tallow | 90.0% |
| Beef tallow fatty acid | 2.0 |
| Antioxidant | 1.0 |
| Water-soluble polymeric dispersing agent (B) | 3.5 |
| Water-soluble polymeric dispersing agent (E) | 3.5% |

Inventive Composition No. 11

| | |
|---|---|
| Beef tallow | 97.0% |
| Water-soluble polymeric dispersing agent (J) | 3.0 |

J: Copolymer of phosphate of dimethylaminoethyl methacrylamide/ sodium acrylate/ sodium vinylsulfonate (3/3/1; MW = 400,000)

Inventive Composition No. 12

| | |
|---|---|
| Beef tallow | 97.0% |
| Water-soluble polymeric dispersing agent (K) | 3.0 |

K: Polycondensation product of quaternary ammonium salt of tetramethylpropylenediamine by benzyl chloride (MW = 100,000)

Inventive Composition No. 13

| | |
|---|---|
| Beef tallow | 96.0% |
| Beef tallow fatty acid | 2.0 |
| Antioxidant | 1.0 |
| Water-soluble polymeric dispersing agent (L) | 1.0 |

L: Polycondensation product of quaternary ammonium salt of hexamethylenetetramine by methylene chloride (MW = 300,000)

Inventive Composition No. 14

| | |
|---|---|
| Beef tallow | 99.0% |
| Water-soluble polymeric dispersing agent (M) | 1.0 |

M: Copolymer of diethylaminoethyl methacrylate/ acetate of vinylpyridine/sodium methacrylate (4/4/2; MW = 150,000)

Inventive Composition No. 15

| | |
|---|---|
| Beef tallow | 96.0% |
| Beef tallow fatty acid | 2.0 |
| Antioxidant | 1.0 |
| Water-soluble polymeric dispersing agent (N) | 1.0 |

N: Propinate of dimethylaminopropyl methacrylamide/ propionate of vinylpyrrolidone/ propionate of ethyleneimine/ sodium acrylate (3/2/3/2; MW = 270,000)

Comparative Composition No. 1

| | |
|---|---|
| Beef tallow | 97.0% |
| Emulsifier (O) | 3.0 |

O: Polyoxyethylene nonylphenyl ether nonionic surfactant having an HLB of 10.8 (MW = 485)

Comparative Example No. 2

Commercially available beef tallow rolling oil

Comparative Example No. 3

| | |
|---|---|
| Paraffin mineral oil | 52.0% |
| 2-ethylhexyl beef tallow fatty acid ester | 25.0 |
| Beef tallow fatty acid | 5.0 |
| Phosphoric ester extreme pressure additive | 2.0 |
| Antioxidant | 1.0 |
| Water-soluble polymeric dispersing agent (A) | 15.0 |

Comparative Example No. 4

| | |
|---|---|
| Beef tallow | 96.95% |
| Beef tallow fatty acid | 2.0 |
| Antioxidant | 1.0 |
| Water-soluble polymeric dispersing agent (C) | 0.05 |

Comparative Example No. 5 (Composition of Japanese Laid-open Application No. 55-147593)

| | |
|---|---|
| Beef tallow | 97.0% |
| Water-soluble anionic polymeric dispersing agent (P) | 3.0 |

P: salt of copolymer of acrylic acid and

-continued maleic acid ($\overline{MW}$ = 3,500)

EXAMPLE 1

Rolling Test a. Rolling test method

Rolling mill: 100 mmϕ×150 mm wide, forged steel roll two-stage rolling mill

Pre-rolling operation: The rolling rolls were polished (about 0.8–1.0μ) along the rolling direction every rolling operation by means of a No. 240 emery paper, defatted with petroleum benzine, and heated to a roll temperature of about 80° C. with hot water.

Material to be rolled: SPCE. S.D material (JISG-3141) Aluminium-killed steel plate. 1 mm thick×30 mm wide×400 mm long plate. The plate was defatted by washing with petroleum benzine and alkali and sufficiently washed with hot water.

b. Oiling method (see FIG. 1)

Predetermined amounts of a test rolling oil and hot water were placed in a stainless steel container 1 and forcedly agitated by means of a homogenizer mixer 3 while keeping the temperature with a heater 2 to prepare a dispersion. 30 minutes after the preparation, a gear pump 4 was operated to feed the dispersion at a spraying rate of 3.0 l/minute (pressure 2.5 kg/cm$^2$) at a dispersion temperature of 60° C. from a nozzle 6 over a roll 7 and a material to be rolled. Indicated at 5 was a pressure gauge.

c. Results

The rolling test results of the inventive and comparative compositions are shown by the relation between the rolling reduction rate and the rolling load in Table 1.

As will be apparent from Table 1, in either 5,000 r.p.m. or 10,000 r.p.m., the compositions of the invention showed more excellent rolling lubricating performance than the comparative composition Nos. 1 and 2 using the emulsifiers. Among the compositions of the invention, the composition Nos. 2, 5 and 10 showed excellent performance even at the high shearing conditions of 10,000 r.p.m. The comparative composition No. 5 was excellent at 5,000 r.p.m. but was extremely low in the performance at 10,000 r.p.m.

TABLE 1

| Rolling oil Composition | Rolling Load Per Unit Width: Rolling Load per Unit Width (kg/mm) (Reduction percentage: 20%) 5,000 r.p.m. | 10,000 r.p.m. | Rolling Load per Unit Width (kg/mm) (Reduction percentage: 40%) 5,000 r.p.m. | 10,000 r.p.m. |
|---|---|---|---|---|
| Inventive Composition | | | | |
| No. 1 | 223 | 235 | 323 | 354 |
| No. 2 | 240 | 210 | 333 | 315 |
| No. 3 | 231 | 255 | 312 | 345 |
| No. 4 | 228 | 243 | 325 | 343 |
| No. 5 | 250 | 207 | 349 | 324 |
| No. 6 | 262 | 271 | 330 | 362 |
| No. 7 | 225 | 245 | 340 | 345 |
| No. 8 | 230 | 238 | 332 | 355 |
| No. 9 | 267 | 257 | 352 | 369 |
| No. 10 | 210 | 200 | 306 | 311 |
| Comparative Composition | | | | |
| No. 1 | 283 | 292 | 374 | 414 |
| No. 2 | 305 | 320 | 411 | 458 |
| No. 5 | 222 | 289 | 332 | 402 |

EXAMPLE 2

Seizure-proof Loading Test (Falex Test)

The seizure-proof load was measured according to a procedure prescribed in the compressive laoding test (Falex test) of the ASTM standard D-3233. A sample to be tested was prepared by diluting each of the rolling oil compositions with water to a concentration of 3% and agitating the dilution in a homogenizer mixer at revolutions of 10,000 r.p.m. The sample solution was applied to a rotary pin at the center of a fixed block using a gear pump under conditions of a spraying amount of 0.1 l/minute (pressure 2.5 kg/cm$^2$) and a dispersion temperature of 50° C.

The results are as shown in Table 2.

TABLE 2

| Rolling Oil Composition | Seizure-proof Load (pounds) |
|---|---|
| Inventive Composition No. 1 | 2,500 |
| Inventive Composition No. 2 | 2,000 |
| Inventive Composition No. 3 | 2,250 |
| Inventive Composition No. 4 | 2,250 |
| Inventive Composition No. 5 | 2,250 |
| Inventive Composition No. 6 | 2,000 |
| Inventive Composition No. 7 | 2,500 |
| Inventive Composition No. 8 | 2,250 |
| Inventive Composition No. 9 | 2,500 |
| Inventive Composition No. 10 | 2,250 |
| Comparative Composition No. 1 | 750 |
| Comparative Composition No. 2 | 1,250 |
| Comparative Composition No. 3 | 500 |
| Comparative Composition No. 4 | 750 |
| Comparative Composition No. 5 | 725 |

As will be apparent from Table 2, the compositions of the invention showed more excellent lubricating performance than the Comparative Composition Nos. 1 and 2. However, when the amount of the water-soluble polymer compounds was greater as in Comparative Composition No. 3 or smaller as in Comparative Composition No. 4, the lubricating performance was poor. The Comparative Composition No. 5 was poor in lubricating performance under high shearing conditions of 10,000 r.p.m. similar to Example 1.

EXAMPLE 3

Each of the metal rolling oil compositions and hot water were mixed at a predetermined concentration (3%, 55° C.) and mixed in a homogenizer at 5,000 and 10,000 r.p.m. to prepare dispersions. The deposition test was conducted by spraying the dispersion to a test piece for 2 seconds by means of a gear pump (pressure 2.5 kg/cm$^2$, spraying amount 1.0 l/minute), drying at a normal temperature, and measuring an amount of deposited oil by the weight method. The test piece used was a SPCC.S.D. (JIS G-3141) having a size of $50\times100\times1$ mm and a surface roughness of $4.0\times5.0\mu$ which was used after defatting with a solvent. Simultaneously, the sample was collected from the spray nozzle and its particle size was measured by the Coulter counter.

The results are as shown in Table 3. The values in parentheses are for 5,000 r.p.m. and the other are for 10,000 r.p.m. The size distributions of the Inventive Composition No. 2 and the comparative Composition No. 5 mixed at 5,000 and 10,000 r.p.m. were measured by the Coulter counter with the results shown in FIGS. 2 and 3.

As will be apparent from Table 3, the compositions of the invention are larger in oil particle size and oil deposition than the Comparative Composition Nos. 1 and 2. The Comparative Composition No. 3 is poor in oil deposition and the Comparative Composition No. 4 is poor in stability of the solution. The Comparative Composition No. 5 has little defference from the inventive compositions under conditions of 5,000 r.p.m. but its particle size becomes smaller under conditions of 10,000 r.p.m. with a considerable lowering of the oil deposition. These results give evidence of the results of Examples 1 and 2.

TABLE 3

Figure 2:
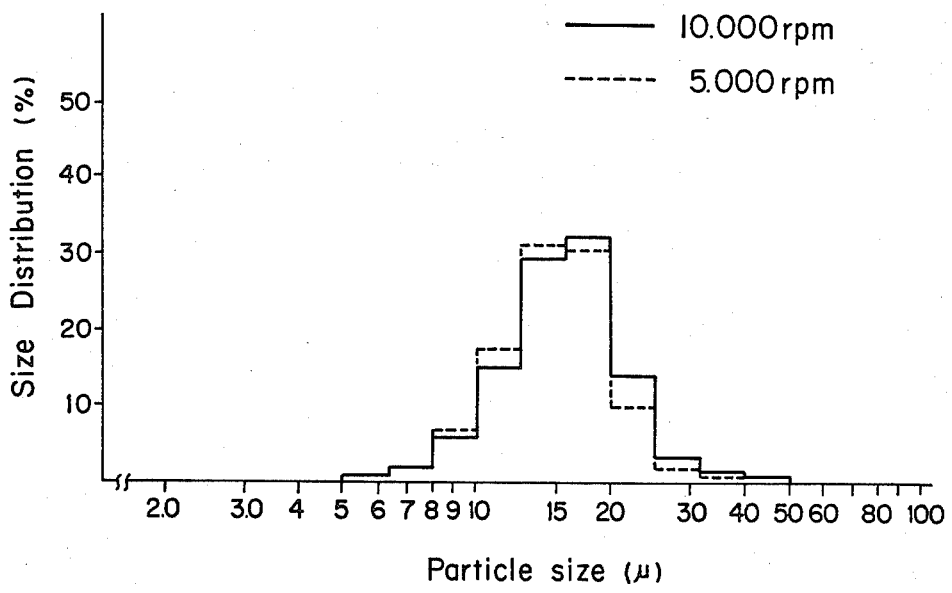
FIG. 2 shows a size distribution of composition No. 2 of the invention obtained by the Coulter counter.
Figure 3:
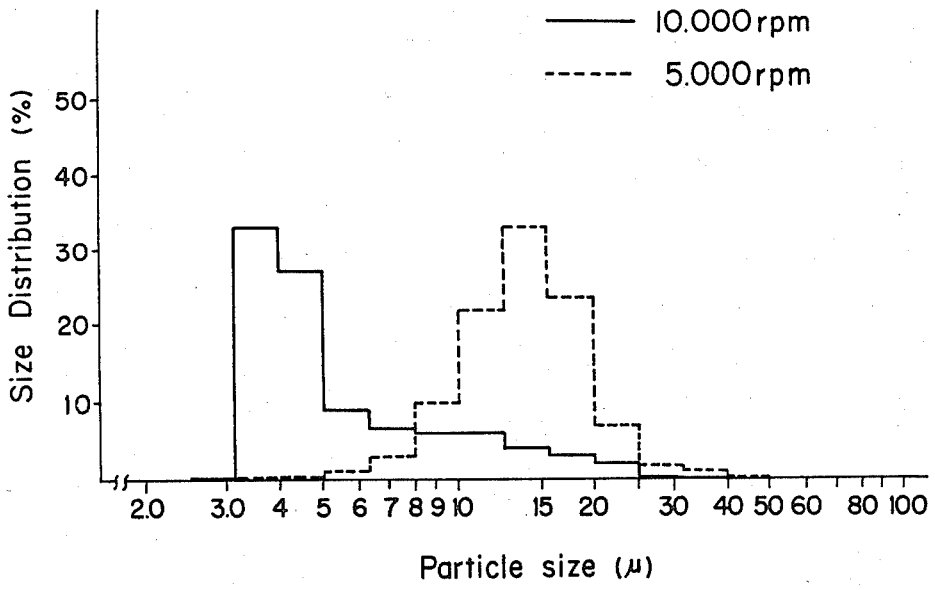
FIG. 3 shows a size distribution of comparative Composition No. 5. 1 . . . container 2 . . . heater 3 . . . homogenizer mixer 4 . . . gear pump 5 . . . pressure gauge 6 . . . nozzle 7 . . . roll.

| Rolling Oil Composition | Average Particle Size ($\mu$) | Amount of Deposited Oil (g/m$^2$) | Size Distribution Measured by Coulter counter |
|---|---|---|---|
| Inventive Composition | | | |
| No. 1 | 13.2 (14.1) | 2.3 (2.5) | FIG. 2 |
| No. 2 | 16.2 (15.3) | 2.8 (2.6) | |
| No. 4 | 13.4 | 2.1 | |
| No. 5 | 18.8 | 3.0 | |
| No. 6 | 12.4 | 2.0 | |
| No. 8 | 15.3 | 2.4 | |
| No. 9 | 14.9 | 2.2 | |
| No. 10 | 20.2 | 3.5 | |
| Comparative Example | | | |
| No. 1 | 8.3 (10.2) | 0.8 (1.2) | FIG. 3 |
| No. 2 | 7.6 | 1.3 | |
| No. 3 | 8.2 | 1.1 | |
| No. 4 | (*) | (*) | |
| No. 5 | 4.7 (14.3) | 0.6 (2.5) | |

(*) This composition was poor in dispersion of oil, making it impossible to measure the average size and the amount of deposited oil.

EXAMPLE 4

Waste-water Treatability

To 1,000 ml of test fluid prepared in the same way as in the seizure-proof loading test (Falex test) of Example 2 was added 3 g of aluminium sulfate, followed by agitation for 2 minutes, after which $Ca(OH)_2$ was added to adjust the pH to 7 and agitated for further 10 minutes. The mixture was allowed to stand for 30 minutes, after which the lower clear layer was collected and COD (Potassium permanganate method) was measured. The results are shown in Table 4.

As will be apparent from Table 4, the compositions of the invention showed more excellent waste-water treatability than the comparative compositions.

TABLE 4

| Rolling Oil Composition | COD (Potassium Permanganate method) |
|---|---|
| Inventive Composition No. 1 | 280 ppm |
| Inventive Composition No. 2 | 150 |
| Inventive Composition No. 3 | 95 |
| Inventive Composition No. 4 | 105 |
| Inventive Composition No. 5 | 53 |
| Inventive Composition No. 6 | 780 |
| Inventive Composition No. 7 | 920 |
| Inventive Composition No. 8 | 510 |
| Inventive Composition No. 9 | 69 |
| Inventive Composition No. 10 | 151 |
| Inventive Composition No. 11 | 123 |
| Inventive Composition No. 12 | 135 |
| Inventive Composition No. 13 | 650 |
| Inventive Composition No. 14 | 730 |
| Inventive Composition No. 15 | 77 |
| Comparative Product No. 1 | 1750 ppm |
| Comparative Product No. 2 | 2230 |

What is claimed is:

1. A metal rolling oil composition characterized by comprising essential components (a) at least one lubricating oil component selected from the group consisting of animal and plant oils, mineral oils and aliphatic acid esters, and (b) at least one water-soluble cationic or amphoteric polymer compound having at least one basic nitrogen atom or cationic nitrogen atom in one recurring unit and having an average molecular weight ranging from 1000–1,000,000, being further characterized as selected from the group consisting of homopolymers of nitrogen-containing monomers represented by general formula (I)

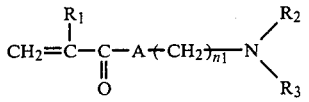

A is —O— or —NH—, $n_1$ is an integer 1–3, $R_1$ is H or $CH_3$, $R_2$ and $R_3$ are H, $CH_3$ or $C_2H_5$, independently, copolymers prepared from compounds of general formula (I) above and at least one vinyl monomer selected from the group consisting of $\alpha,\beta$-unsaturated carboxylic acids, sulfonic acid group-containing vinyl compounds and aliphatic olefins having 2–20 carbon atoms, and ring-opened polymers of ethyleneimine;

said components (a) and (b) being dispersed in water form.

2. The metal rolling oil composition according to claim 1, wherein the water-soluble cationic or amphoteric polymer compound is contained in an amount of 0.1 to 10 wt% of the total composition.

3. The metal rolling oil composition of claim 1, wherein said lubricating oil component is beef tallow and said water-soluble polymer compound is a copolymer of the neutralized reaction product of dimethylaminoethyl methacrylate with glycollic acid and sodium acrylate.

4. The metal rolling oil composition according to claim 1, wherein the $\alpha,\beta$-unsaturated carboxylic acid to be copolymerized with the nitrogen-containing monomer is acrylic acid, methacrylic acid or maleic acid.

* * * * *